US005746190A

United States Patent [19]

Honda

[11] Patent Number: 5,746,190

[45] Date of Patent: May 5, 1998

[54] EGR SYSTEM USING PERPENDICULARLY ARRANGED CONTROL VALVE

[75] Inventor: Akihiro Honda, Kariya, Japan

[73] Assignee: Denso Corporation, Kariya, Japan

[21] Appl. No.: 764,651

[22] Filed: Dec. 11, 1996

[30] Foreign Application Priority Data

| | | | |
|---|---|---|---|
| Dec. 21, 1995 | [JP] | Japan | 7-333658 |
| Aug. 26, 1996 | [JP] | Japan | 8-223922 |

[51] Int. Cl.[6] ..... F02M 25/07

[52] U.S. Cl. ..... 123/568

[58] Field of Search ..... 123/568, 569, 123/570, 571

[56] References Cited

U.S. PATENT DOCUMENTS

| | | | |
|---|---|---|---|
| 3,954,091 | 5/1976 | Stumpp | 123/568 |
| 3,983,854 | 10/1976 | August | 123/568 |
| 4,171,689 | 10/1979 | Eheim | 123/568 |
| 4,222,356 | 9/1980 | Ueda et al. | 123/568 |
| 4,224,912 | 9/1980 | Tanaka | 123/568 |
| 4,924,840 | 5/1990 | Wade | 123/568 |
| 5,056,309 | 10/1991 | Linder et al. | 123/568 |
| 5,265,578 | 11/1993 | Zabeck et al. | 123/568 |
| 5,333,456 | 8/1994 | Bollinger | 123/568 |

FOREIGN PATENT DOCUMENTS

| | | |
|---|---|---|
| 349729 | 5/1989 | European Pat. Off. . |
| 62-135863 | 8/1987 | Japan . |
| 4-66347 | 6/1992 | Japan . |

*Primary Examiner*—Willis R. Wolfe
*Attorney, Agent, or Firm*—Nixon & Vanderhye P.C.

[57] ABSTRACT

Most of the components of an EGR control valve except for a negative pressure actuator, such as a valve seat member, a valve member, a rod, a sliding member, and part of a throttle body, are accommodated in a throttle body and disposed adjacent to an air intake passage. Thus, the number of components of the EGR control valve projecting from the throttle body is reduced, thereby reducing the space around the air intake passage. The rod is disposed in parallel with a throttle shaft, so that a throttle valve and the components of the EGR control valve can be disposed concentratively on the opposite ends of the throttle shaft. Accordingly, the overall size of the recirculation system is reduced.

26 Claims, 5 Drawing Sheets

EGR SYSTEM USING PERPENDICULARLY ARRANGED CONTROL VALVE

BACKGROUND OF THE INVENTION

1. Field of the Invention

The present invention relates to an EGR (Exhaust Gas Recirculation) system using a control valve for opening and closing an exhaust gas passage designed to introduce exhaust gas into an air intake passage of an internal combustion engine.

2. Description of Related Art

As a known exhaust gas recirculation system which is designed to reduce the amount of NOx produced in exhaust gas by lowering the combustion temperature by recirculating a part of the exhaust gas of an engine through an air intake passage, there is one disclosed in European Patent Application Laid-Open No. 349729. According to this system, an EGR control valve is provided in proximity to a throttle valve controller, thus forming a single unit. In this system, a valve member of the EGR control valve and an actuator for drivingly open and close the valve member are respectively disposed on the radially opposite sides of the air intake passage, whereby a rod connecting the valve member and the actuator with each other can be cooled with the flow of the intake air.

In the case of this exhaust gas recirculation system, however, the valve member of the EGR control valve and the actuator are respectively disposed on the radially opposite sides of the air intake passage, so that the valve member, piping of the exhaust gas passage to be opened and closed by the valve member, and the actuator project largely in the radially opposite directions, thereby giving rise to a problem that the overall dimension of the system is increased. In addition, a shaft of the EGR control valve connecting the valve member and the actuator with each other and a rotational shaft of the throttle valve are disposed such that they intersect perpendicularly to each other. Therefore, components belonging to the EGR control valve and those belonging to the throttle valve controller project in all four directions from the throttle body and as a result, the overall dimension of the system is increased. As the components belonging to the throttle valve controller, there may be cited a lever for adjusting the degree of opening of the throttle valve, the actuator, an opening degree sensor, and the like.

Furthermore, there is another exhaust gas recirculation system disclosed in Japanese Utility Model Laid-Open Hei No. 4-66347. In this system, too, the EGR control valve is integrally installed to the throttle body.

In the case of this exhaust gas recirculation system, the EGR control valve is installed outside the throttle body, thereby causing an increase in the overall dimension of the system. Furthermore, the throttle valve and the EGR control valve are disposed in such a manner that the axial line of the EGR control valve is perpendicular to the rotational shaft of the throttle valve, thereby giving rise to a problem, that is, an increase in the overall dimension of the system.

As discussed in the foregoing, those conventional exhaust gas recirculation systems have a drawback that they need considerably large installation space when installing the EGR control valve to the exhaust gas passage or the throttle body, thereby giving rise to a problem, that is, the increase in the overall dimension of the system.

SUMMARY OF THE INVENTION

It is an object of the present invention to solve such problems by providing an EGR control valve capable of reducing the installation space when installed to an air intake passage.

It is another object of the present invention to provide an exhaust gas recirculation system with reduced size or dimensions by arranging a control valve perpendicularly to an air intake passage.

According to the present invention, an EGR control valve is disposed perpendicularly to an air intake passage and components (component parts) of the EGR control valve project in the proximity of but deviated from a diameter of an air intake passage, so that the space required around the air intake passage can be minimized.

Preferably, a coupling device interposed between a communicating port of an exhaust gas passage leading to the air intake passage and an actuator is cooled by the flow of the intake air, so that the high-temperature heat of the exhaust gas can be prevented from being transmitted to the actuator.

Preferably, a valve member of the EGR control valve is driven in an exhaust upstream direction to open an exhaust passage so that the exhaust gas does not cause the EGR control valve to be opened, so that the leak of the exhaust gas can be prevented when closing the EGR control valve.

Preferably, a diaphragm actuator is employed as an actuator, so that it is possible to drivingly open or close a valve member with a simple mechanism.

Preferably, components of a throttle valve controller and those of the EGR control valve are respectively disposed on the opposite sides of a throttle shaft, so that those components do not project to perpendicularly intersect the throttle shaft. Furthermore, at least a portion of the EGR control valve is accommodated in the throttle body, so that the components of the EGR control valve project to the corner of a throttle body on the side on which those of the throttle valve controller project. Thus, the overall dimension of the recirculation system is reduced, thus realizing a smaller installation space for the recirculation system as a whole.

Preferably, the throttle valve is not exposed to the high-temperature exhaust gas, so that the temperature of the system can be prevented from rising. Furthermore, the foreign matters in the exhaust gas can be prevented from depositing on the throttle valve, so that the smooth rotation of the throttle valve can be maintained for high-accuracy control of the flow rate of the intake air.

BRIEF DESCRIPTION OF THE DRAWINGS

Other objects, features and advantages of the invention will become more apparent from the following detailed description when read with reference to the accompanying drawings, in which.

DETAILED DESCRIPTION OF PRESENTLY PREFERRED EMBODIMENTS

Figure 1:
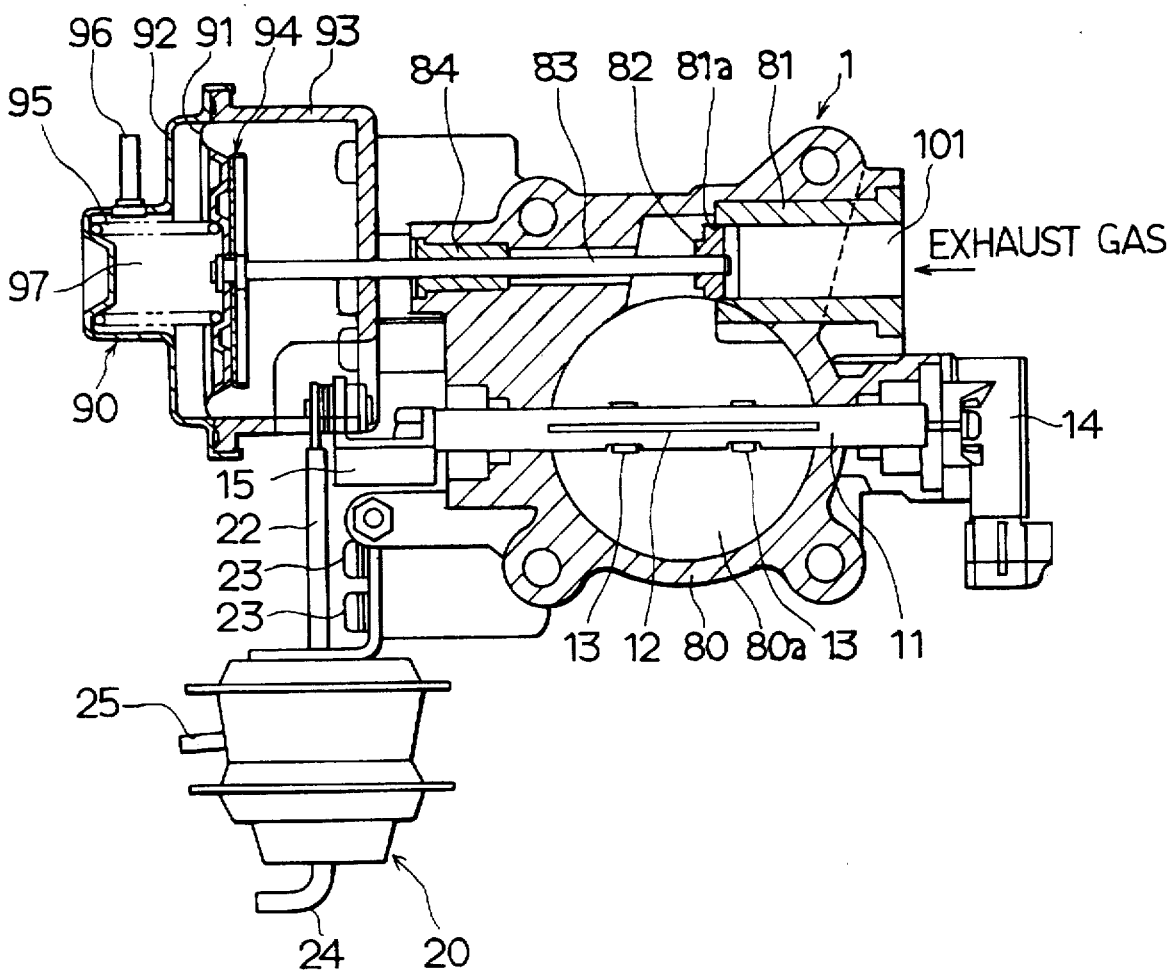
FIG. 1 is a cross-sectional view showing an exhaust gas recirculation system according to a first embodiment of the present invention, the view being taken along the line I—I in FIG. 2;.

Various embodiments of the present invention will be explained below with reference to the accompanying drawings, in which the same or similar component parts are denoted by the same reference numerals.

(First Embodiment)

Figure 2:
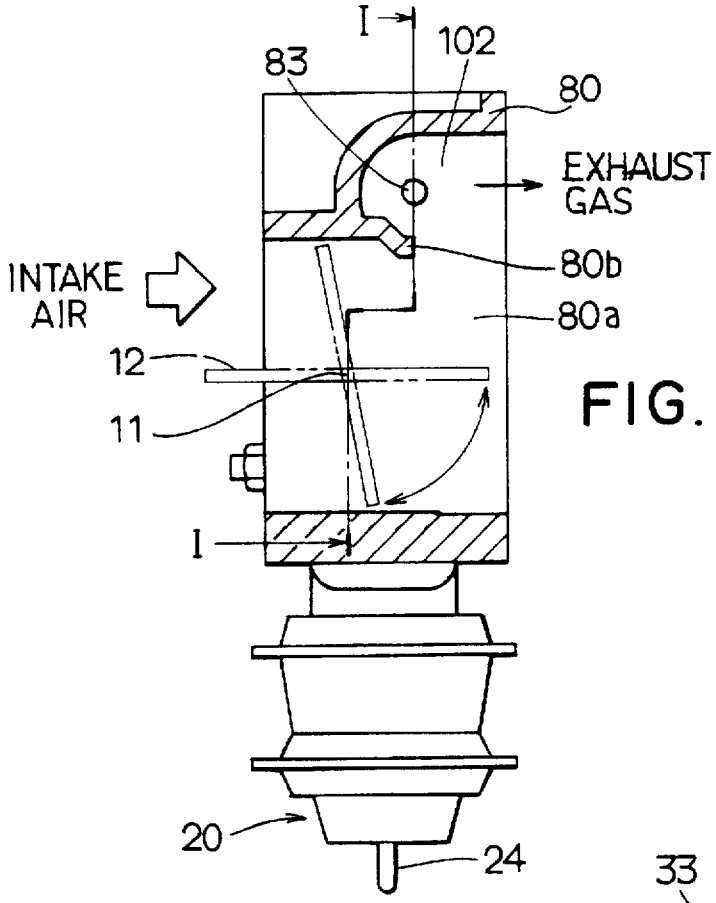
FIG. 2 is a cross-sectional view of the exhaust gas recirculation system according to the first embodiment of the present invention.

The first embodiment of the present invention is illustrated in FIG. 1 and FIG. 2.

An exhaust gas recirculation system 1 as shown in FIG. 1 is disposed on the upstream side of an intake air flow with respect to an intake manifold of a multi-cylinder engine (not shown). The exhaust gas recirculation system 1 according to this embodiment is an assembly formed integrally with a throttle device as an intake throttle of a diesel engine and an EGR control valve. A throttle shaft 11 as a rotational shaft of a throttle valve 12 is pivotally supported by a throttle body 80 of the exhaust gas recirculation system 1, and the throttle valve 12 is mounted on the throttle shaft 11 with screws 13 so as to be rotatable together with the throttle shaft 11. The throttle valve 12 controls the flow rate of intake air passing through an air intake passage 80*a* formed in the throttle body 80.

A rotation sensor 14 is attached to one end of the throttle shaft 11 and outputs an opening degree signal of the throttle valve 12 to an ECU (Engine Control Unit, not shown). A lever 15 designed to rotate together with the throttle shaft 11 is attached to the other end of the throttle shaft 11. A negative pressure actuator 20 is attached to the throttle body 80 with screws 23. The lever 15 and the throttle shaft 11 are caused to rotate by a rod 22 which makes a reciprocating motion together with a diaphragm (not shown) of the negative pressure actuator 20. The diaphragm of the negative pressure actuator 20 is shifted towards the negative pressure side causing the throttle shaft 11 to rotate towards closing direction when a negative pressure is supplied from air flow pipes 24 and 25. The negative pressure applied to the negative pressure actuator 20 is supplied from a vacuum pump (not shown).

The EGR control valve comprises a valve seat member 81, a valve member 82, a rod 83, a sliding member 84, a portion of the throttle body 80 and a negative pressure actuator 90. The EGR control valve as a whole has a cylindrical construction including all these components. The EGR control valve is disposed on the throttle body 80, which comprises the intake passage whose axial direction intersects the axial direction of the EGR control valve. Furthermore, the EGR control valve is disposed on a wall surface of the throttle body 80, which comprises the intake passage deviating from a diameter of the air intake passage. The valve unit comprising the valve seat member 81 and the valve member 82, and the negative pressure actuator 90 are disposed respectively on the opposite sides of the throttle body 80 and adjacent to the air intake passage 80*a*. Thus, the number of components projecting from the throttle body 80 is reduced, thereby reducing the space around the air intake passage 80. In this case, being adjacent to the air intake passage means that these components are disposed in proximity to the air intake passage or partially exposed to the air intake passage. Furthermore, as shown in FIG. 2, the EGR control valve is overlapped with the projection area of the throttle valve 12 in the radial direction of the air intake passage 80*a* perpendicularly intersecting the throttle shaft 11. Furthermore, the EGR control valve is located on one side of one piece of the throttle valve towards which the throttle valve moves when it opens, that is, the upper side in FIG. 2, and is provided with a communicating port of the exhaust gas passage leading to the air intake passage 80*a*.

As shown in FIG. 1, the valve seat member 18 is fixed by being fit on the exhaust gas introduction side of the throttle body 80. The valve seat member 81 is attached to one end of the rod 83 on the downstream side of the exhaust gas after the valve seat 81*a* formed with the valve seat member 81. When the valve member 82 is moved towards the left-hand side in FIG. 1, that is, the downstream side of the exhaust gas to move away from the valve seat 81*a*, an exhaust gas inlet port 101 is made to communicate with the air intake passage 80*a*. The rod 83, serving not only as the shaft of the EGR control valve but also as the coupling device connecting the air intake passage 80*a* and the negative pressure actuator 90, is disposed perpendicularly intersecting the axial direction of the air intake passage 80*a*, deviating from the diameter of the air intake passage 80*a* and in parallel to the throttle shaft 11. Thus, the negative pressure actuator 90 to be connected to the end of the rod 83 is disposed at the corner of the throttle body 80 on the same side as that on which the negative pressure actuator 20 is mounted.

As shown in FIG. 2, a communicating port 102 for introducing the exhaust gas into the flow of the intake air is partitioned by a partition wall 80*b* and opens only towards downstream direction on the downstream side of the intake air from the throttle valve 12, and the exhaust gas introduced through the communicating port 102 is mixed with the intake air on the downstream side of the intake air flow with respect to the throttle valve 12. As seen from FIG. 1, the other end of the rod 83 is connected to a movable member 94 of the negative pressure actuator 90, and the rod 83 is supported by the sliding member 84 for reciprocating motion. The sliding member 84 also serves for preventing the leakage of the air and exhaust gas.

A diaphragm 91 of the negative pressure actuator 90 is interposed between a first case 92 and a second case 93. In a condition as shown in FIG. 1 in which the negative pressure is not applied to a spring chamber 97, the rod 83 is urged towards the right-hand direction in FIG. 1 by the force of a compressed coil spring 95. Thus, when the valve member 82 comes into contact with the valve seat 81*a*, the communication between the exhaust gas inlet port 101 and the air intake passage 80*a* is interrupted.

When the negative pressure from the air flow pipe 96 is applied to the spring chamber 97, both the movable member 94 and the rod 83 are shifted towards the left-hand side in FIG. 1, causing the valve member 82 to be separated from the valve seat 81*a*. This causes the exhaust gas introduced through the exhaust gas inlet port 101 to be mixed with the intake air at the downstream side of the intake air flow from the throttle valve 12. When inactive components such as $H_2O$, $N_2$, $CO_2$, etc. is mixed into the fuel-air mixture for combustion, the combustion temperature drops, so that the generation of NOx can be reduced.

In the case of the first embodiment, the EGR control valve is disposed in parallel to the throttle shaft 11 and at the nearest possible location to the throttle valve 12, whereby the components projecting from the throttle body 80 towards the throttle shaft 11, which perpendicularly intersects the throttle body, are eliminated, and the components of the throttle valve 12 and the components of the EGR control valve can respectively be disposed concentratively on both sides corresponding to the two ends of the throttle shaft 11. Furthermore, the negative pressure actuator 90 as a part of the EGR control valve is disposed at the corner of the throttle body 80 on the side on which the components of the throttle valve 12 project, so that the overall dimension or size of the recirculation system can be reduced, thereby contributing to the reduction of the installation space of the recirculation system as a whole to the largest possible extent.

In the case of the first embodiment, the valve member 82 is disposed on the downstream side of the exhaust gas flow with respect to the valve seat 81*a*, and the exhaust gas is introduced into the air intake passage 80*a* from the exhaust gas inlet port 101 through the communicating port 102 when the valve member 82 is moved towards the downstream side of the exhaust gas flow. Thus, the direction in which the movable member 94 of the negative pressure actuator 90 moves towards the negative pressure side can be made to coincide with the direction in which the valve member 82 opens, so that the construction of the coupling device, by which the driving force of the negative actuator 90 is transmitted to the valve member 82, can be simplified.

According to the first embodiment, the exhaust gas introduced from the communicating port 102 is mixed with the intake air on the downstream side of the intake air flow with respect to the throttle valve 12, so that the exhaust gas is prevented from directly contacting the throttle valve 12. Thus, the throttle valve 12 can be prevented not only from being directly exposed to the high-temperature exhaust gas but also from having the foreign matters in the exhaust gas deposited thereon to hinder the rotation of the throttle valve 12.

According to the first embodiment, even when the portion of the rod 83 and the valve member 82 are heated to a high temperature by being exposed to the high-temperature exhaust gas introduced from the exhaust gas inlet port 101, the portion of the throttle body 80, constituting the exhaust gas passage, and the rod 83 are exposed to the air intake passage 80*a*. Furthermore, the negative pressure actuator 90 is disposed apart from the valve member 82. Thus, even when the valve member 82, throttle body 80 on the side on which the exhaust gas is introduced and the rod 83 are heated to a high temperature, the negative pressure actuator 90 will not be heated to a high temperature, so that the diaphragm 91 installed inside the negative pressure actuator 90 can be prevented from deteriorating due to the effect of the heat. Thus, the negative pressure actuator 90 can be prevented from making poor performance, so that the introduction of the exhaust gas into the air intake passage can be controlled with high accuracy.

According to this embodiment, the valve seat member 81 and the valve member 82 constitute the EGR valve. The EGR valve, the negative pressure actuator 90 as an actuator, the rod 83 connecting them and the portion of the throttle body 80 surrounding these components constitute a substantially cylindrical EGR control valve. On the other hand, the throttle body 80 separates and forms the air intake passage 80*a* having spherical cross section. The cylindrical EGR control valve is disposed so that its axial direction crosses, preferably intersects perpendicularly, the axial direction of the air intake passage 80*a*. Furthermore, the EGR control valve is disposed deviating from the diameter of the air intake passage 80*a*. In this embodiment, the EGR control valve is embedded in and supported by the throttle body 80 which is formed with the air intake passage 80*a*, so that the overall dimension of the recirculation system can be reduced even in combination with the EGR control valve. Especially, the dimensions can further be reduced by disposing the negative pressure actuator 90 and the EGR valve on both sides (of the recirculation system).

Furthermore, in forming the air intake passage 80*a* having the throttle shaft 11 integrally with the EGR control valve, the overall dimension can be prevented from increasing too much by disposing the EGR control valve in parallel to the throttle shaft 11. In addition, for the throttle valve 12 supported by the throttle shaft 11 has one piece designed to move towards upstream side from the throttle shaft 11 and the other piece designed to move towards downstream side from the throttle shaft 11, the overall dimension can further be reduced with respect to the axial direction by disposing the EGR control valve on the side of the piece designed to move towards the upstream side.

Also, the negative pressure actuator 90 can thermally be protected by being disposed so that it is exposed inside the air intake passage 80*a*.

Furthermore, the junction of the EGR control valve and the air intake passage 80*a* is preferably provided with a partition wall 80*b* as a guiding member for guiding the flow of exhaust gas towards downstream in the air intake passage 80*a*. With this guiding member the throttle shaft 11 and throttle valve 12 are protected not only from the foreign matters such as the sludge, etc. but also from the heat. Furthermore, according to this embodiment, the partition wall 80*b* as the guiding member almost fully covers the rod 83 but may be provided with a partial hole so that the rod 83 is exposed to the air drawn through the hole. For similar reason, a passage may be defined for cooling the rod 83.

Furthermore, according to the embodiment, the throttle unit for the diesel engine to be driven by the negative pressure actuator is combined with the EGR control valve; however, the EGR control valve according to the present invention may be combined with the throttle unit for gasoline engine which is driven either by accelerator pedal connected with a wire or by a motor.

(Second Embodiment)

Figure 4:
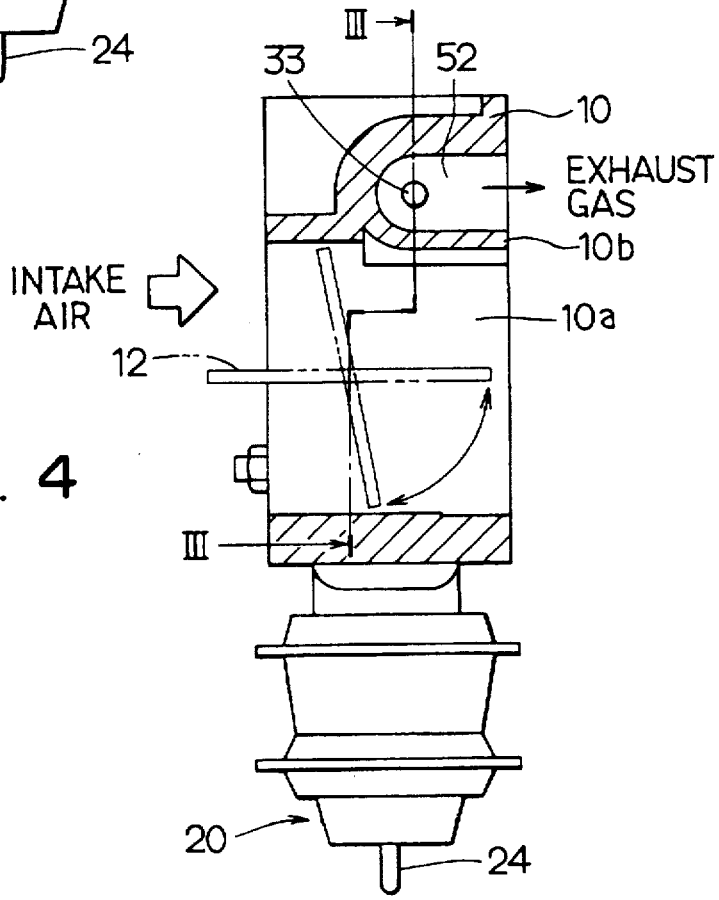
FIG. 4 is a cross-sectional view of the exhaust gas recirculation system according to the second embodiment of the present invention.
Figure 3:
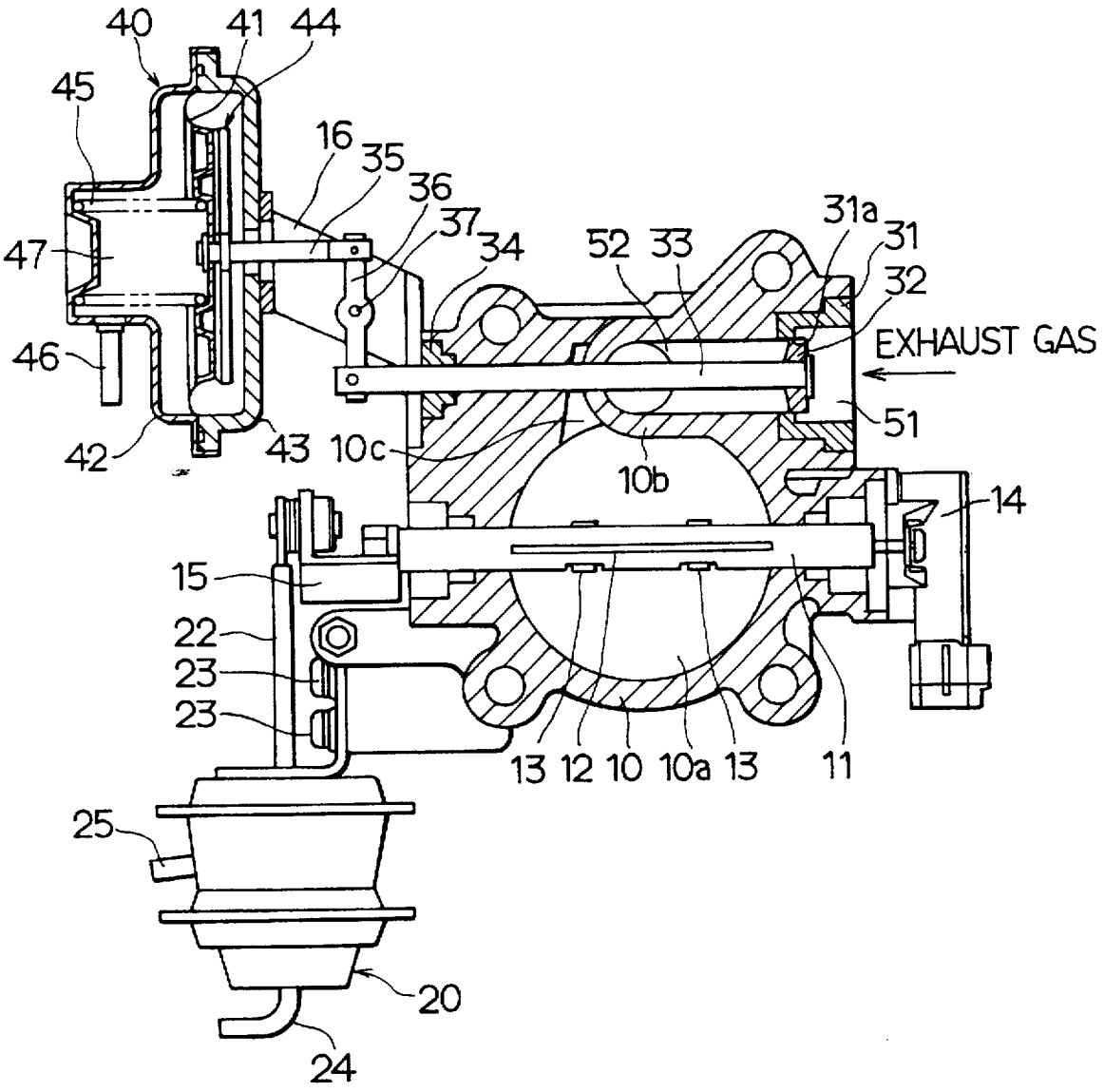
FIG. 3 is a cross sectional view showing an exhaust gas recirculation system according to a second embodiment of the present invention, the view being taken along the line III—III in FIG. 4.

The exhaust gas recirculation system according to the second embodiment is shown in FIG. 3 and FIG. 4.

A valve seat member 31 is fit in and fixed to a throttle body 10 on the side on which the exhaust gas is introduced, forming a exhaust gas inlet port 51. The exhaust gas from an engine is introduced towards the direction intersecting an air intake passage 10*a* through the exhaust gas inlet port 51. An exhaust gas passage 52 is formed in the throttle body 10 intersecting, from its exhaust gas inlet port 51, the air intake passage 10*a*, bent orthogonally at substantially the center of the exhaust gas passage 52 when viewed from above FIG. 3 and extends towards the downstream side of intake air flow along the air intake passage 10*a*. As shown in FIG. 4, the exhaust gas passage 52 is not communicating with the air intake passage 10*a* formed with the throttle body 10, and the exhaust gas introduced into the exhaust gas passage 52 is mixed into the intake air on the downstream side of the air intake passage 10*a*. As shown in FIG. 3 and FIG. 4, even when the high-temperature exhaust gas is introduced into the exhaust gas passage 52, the temperatures of the bottom and sides of the partition wall 10*b* remain considerably lower than the temperature of the exhaust gas, since the bottom and sides of the partition wall 10*b* of the throttle body 10, which constitutes the exhaust gas passage 52, are cooled by intake air flow by being directly exposed to the air intake passage 10*a*. Thus, even when the high-temperature exhaust gas is introduced into the exhaust gas passage 52, the temperature of the throttle body 10 disposed around a rod 33, which is located on the left-hand side in FIG. 3, is maintained at a considerably lower level than the temperature of the exhaust gas.

A valve member 32 is fixed to an end of the rod 33 on the upstream side of the exhaust gas flow with respect to a valve seat 31*a*. When a valve member 32 comes into contact with a valve seat 31*a* formed with the valve member 31, the communication between the exhaust gas inlet port 51 and the exhaust gas passage 52 is interrupted. The rod 33 is supported to be slidable for reciprocating motion by the internal wall of the throttle body 10 and a sliding member 34, and the central portion of the rod 33 is located in proximity of the air intake passage 10*a*. The sliding member 34 also serves for preventing the leak of the exhaust gas. A concave space 10*c* formed with the internal wall of the throttle body 10 communicates with the air intake passage 10*a*, and the near-center portion of the rod 33 is located in the concave space 10*c*, so that the rod 33 is exposed to the intake air flow to be cooled. Furthermore, as discussed previously, the temperature of the throttle body 10 surrounding the rod 33 located on the left-hand side in FIG. 3 is considerably lower than the temperature of the exhaust gas, and thus the rise of the temperature of the rod 33 on the side of a coupling member 36 can be controlled.

A negative pressure actuator 40 is disposed apart from the valve member 32 by being disposed on the opposite side of the valve member 32 with the air intake passage 10*a* interposed therebetween and fixed to a stay 16 attached to the throttle body 10. A diaphragm 41 of the negative pressure actuator 40 is interposed between a first case 42 and a second case 43, the first case 42 and the second case 43 being fixed by caulking. A movable member 44 including the diaphragm 41 is urged towards the right-hand direction in FIG. 3 by compressed coil spring 45. The coupling member 35, which reciprocates leftward and rightward together with the movable member 44 in FIG. 3, is fixed to the movable member 44. The coupling member 35 and the rod 33 are pivotally connected respectively to the opposite ends of the coupling member 35 by means of pins and the like, and the coupling member 36 is pivotally attached to the stay 16 with the pin 37. The rod 33, coupling member 35 and coupling member 36 constitute a coupling device and serves for driving the valve member 32 in the direction reverse to the direction of movement of the movable member 44. The negative pressure applied to the negative pressure actuator 40 is given from a vacuum pump (not shown).

In a condition as shown in FIG. 3 in which the negative pressure is not applied to a spring chamber 47, the movable member 44 and coupling member 35 are urged towards the right-hand direction in FIG. 3. The coupling member 36 is kept pushed clockwise around the pin 37. The rod 33 and valve member 32 are pulled towards the left-hand direction in FIG. 3, the direction reverse to the direction towards which the movable member 44 is pulled, so that the valve member 32 is made to contact the valve seat 31*a*. Thus, the communication between the exhaust gas inlet port 51 and the exhaust gas passage 52 is interrupted, whereby the exhaust gas is prevented from entering the air intake passage following the air intake passage 10*a*.

When the negative pressure from an air flow pipe 46 is applied to the spring chamber 47, the movable member 44 is shifted towards the negative pressure side, that is, the left-hand side in FIG. 3, and the coupling member 36 rotates counterclockwise around the pin 37. Then, when the valve member 32 is separated from the valve seat 31 as the rod 33 and the valve member 32 moves towards the right-hand direction in FIG. 3, that is, the direction reverse to the direction of movement of the movable member 44, the exhaust gas is introduced into the air intake passage on the downstream side of the air intake passage 10*a* through the exhaust gas passage 52.

According to the second embodiment, the valve member 32 is driven towards the direction reverse to the direction of movement of the movable member 44 of the negative pressure actuator 40, so that the valve member 32 can be moved towards the upstream side of the exhaust gas flow to introduce the exhaust gas into the air intake passage, without complicating the construction of the negative pressure actuator.

Furthermore, in this recirculation system, the valve member 32 is located on the upstream side of the exhaust gas flow with respect to the valve seat 31*a*, and the exhaust gas inlet port 51 is made to communicate with the exhaust gas passage 52 by letting the valve member 32 move towards the upstream side of the exhaust gas flow, so that, as long as the valve member 32 is kept in contact with the valve seat 31*a*, the pressure of the exhaust gas will not act to cause the valve member 32 to be separated from the valve seat 31*a*, so that the inflow of the exhaust gas into the exhaust gas passage 52 can be prevented when introducing the exhaust gas.

(Third Embodiment)

Figure 5:
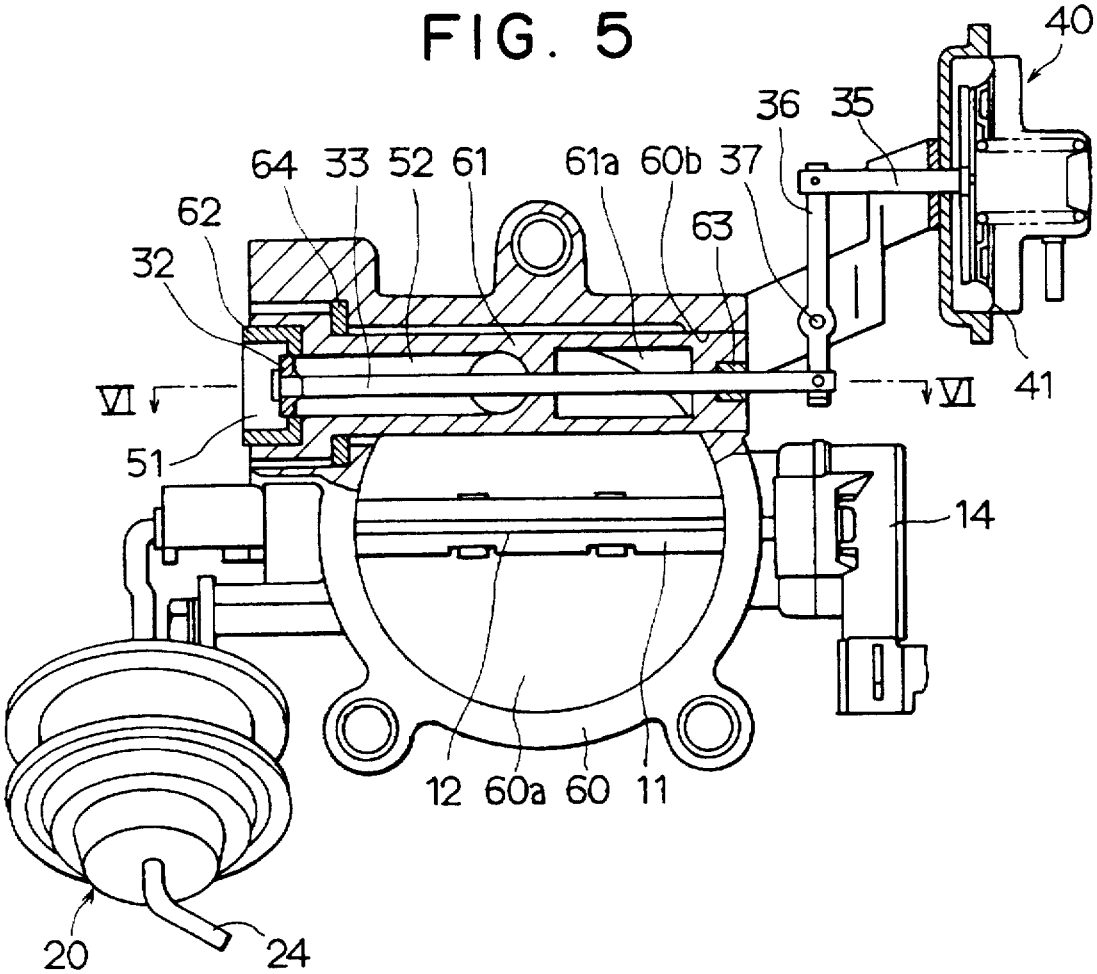
FIG. 5 is a cross-sectional view of an exhaust gas recirculation system according to a third embodiment of the present invention.
Figure 6:
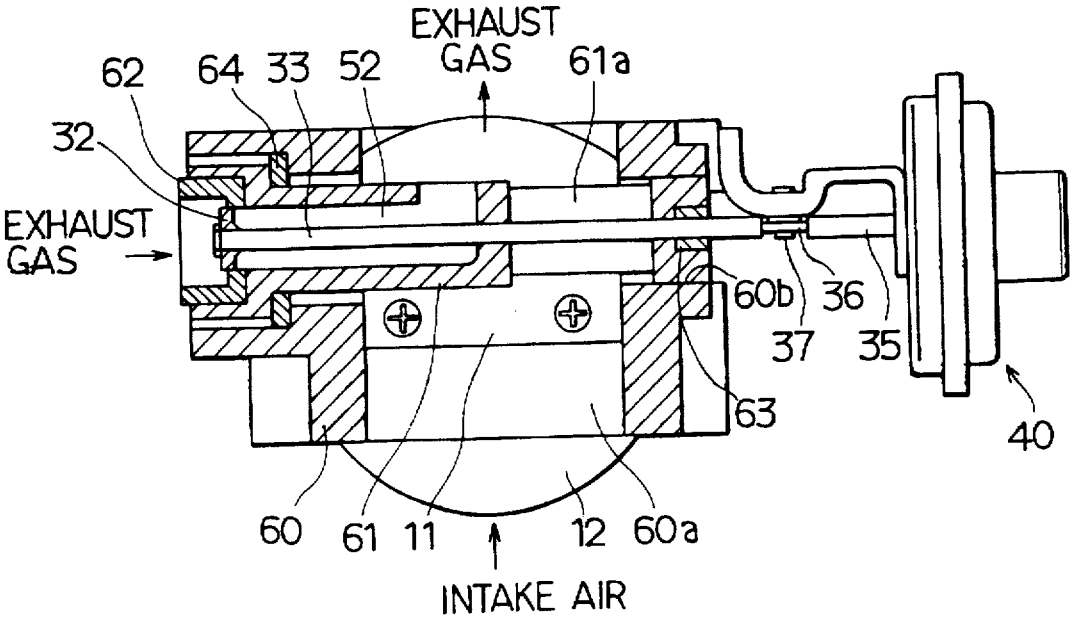
FIG. 6 is a cross-sectional view taken along the line VI—VI in FIG. 5.

The third embodiment of the present invention is illustrated in FIG. 5 and FIG. 6.

According to the third embodiment, the throttle body comprises a main throttle body 60 and a housing 61. The housing 61 is formed separately from the main throttle body 60 and formed with an exhaust gas passage 52. A valve member 32, a rod 33, the housing 61, a valve seat member 62 and a sliding member 63 constitute the subassembly of an EGR control valve and are assembled before being incorporated into the main throttle body 60. The subassembly is inserted into the main throttle body 60 from the exhaust gas introduction side and guided to a guiding member 60*b* of the main throttle body 60 to be assembled and supported by the guiding member 60*b*. The outer wall of the housing 61, except the area in contact with guiding member 60*b*, is kept separated from the main throttle body 60. An annular heat insulating packing 64 is interposed between the housing 61 on the exhaust gas introduction side and the main throttle body 60, and the housing 61 is supported by this heat insulating packing 64.

As shown in FIG. 6, the discharge port of the exhaust gas passage 52 opens inside the air intake passage 60*a*, so that the exhaust gas is mixed into the intake air in the air intake passage 60*a*. The housing 61 formed with the exhaust gas passage 52 is directly exposed to the air intake passage 60*a*. Furthermore, an air intake port 61*a* is formed on the negative pressure actuator side of the housing 61, and the rod 33 is disposed intersecting the air intake port 61*a*. Thus, the rod 33 and the internal wall of the housing 61 formed with the air intake port 61*a* are exposed to the intake air flow in the intake passage 60*a*, so that the housing 61 and the rod 33 are sufficiently cooled by the intake air flow, thereby preventing the coupling member 36, coupling member 35 and diaphragm 41 from being heated to a high temperature. As a result, the diaphragm 41 can be prevented from deteriorating due to the effect of the heat.

Furthermore, the exhaust gas introduction side of the housing 61 is supported by the heat insulating packing 64, while the negative pressure actuator side of the housing 61 is supported by the guiding member 60*b* of the main throttle body 60. The outer wall of the housing 61 between these two supporting members is kept separated from the main throttle body 60 and exposed to the intake air flow. Thus, (1) even when the exhaust gas introduction side of the housing 61 is heated to a high temperature by the introduced exhaust gas, the transmission of the heat from this heated portion to the main throttle body 60 is interrupted by the heat insulating packing 64, and (2) the non-contact portion of the housing 61 is cooled by the intake air flow, so that, even when the housing 61 is in contact with the guiding member 60b, the guiding member 60b is prevented from being heated to a high temperature. Thus, even when the exhaust gas introduction side of the housing 61 is heated to a high temperature, the rise of the temperature of the main throttle body 60 can be controlled, so that the members with low heat resistance such as the rubber oil seal incorporated into the main throttle body 60 can be prevented from deteriorating due to the effect of the heat. Furthermore, the rise of the temperature and the resultant expansion of the throttle valve 12 can be controlled, so that the clearance between the throttle vale 12 and the main throttle body 60, both being required to operate with high accuracy, can be maintained, and the interference between the throttle valve 12 and the main throttle body 60 can be prevented.

According to the third embodiment, the circular cross section of the air intake passage 60a is crossed by part of the housing 61 and part of rod 33, contributing to further reduction of the overall dimension of the recirculation system.

(Fourth Embodiment)

Figure 7:
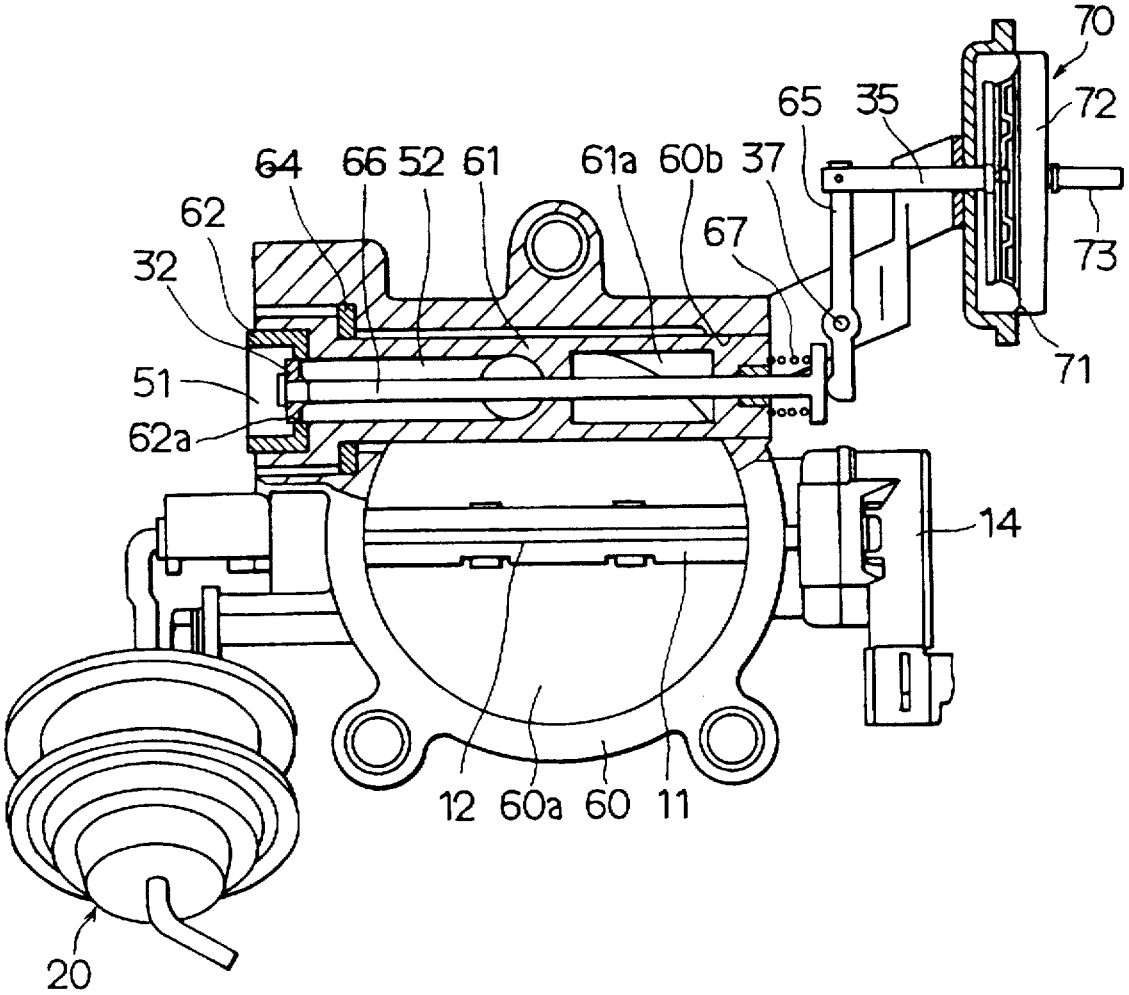
FIG. 7 is a cross-sectional view of an exhaust gas recirculation system according to a fourth embodiment of the present invention.

The fourth embodiment of the present invention is illustrated in FIG. 7.

A negative pressure actuator 70 according to the fourth embodiment is not provided with compression coil springs for keeping a diaphragm 71 pushed against the negative pressure. One end of a coupling member 65 is pivotally connected to the coupling member 35 by means of a pin or the like, while the other end of the coupling member 65 abuts on a rod 66. The rod 66 is urged towards the right-hand direction in FIG. 7 by compression coil springs 67.

In a condition as shown in FIG. 7 in which any negative pressure from an air flow pipe 73 is not applied to a negative pressure chamber 72, the rod 66 is urged towards the right-hand direction by the pushing force of the compression coil spring 67, causing the valve member 32 to contact a valve seat 62a formed with a valve seat member 62, thereby further causing the communication between the exhaust gas inlet port 51 and the exhaust gas passage 52 to be interrupted.

When the negative pressure from the air flow pipe 73 is applied to the negative pressure chamber 72, the coupling member 35 is pulled towards the right-hand direction in FIG. 7 to cause the coupling member 65 to rotate clockwise. This further causes the rod 66 and the valve member 32 to move towards the left-hand direction in FIG. 7 against the pushing force of the compression coil spring 67, thereby causing the valve member 32 to separate from a valve seat 62a and resultant introduction of the exhaust gas into the exhaust gas passage 52 from the exhaust gas inlet port 51.

According to the fourth embodiment, the absence of the compression coil spring in the negative pressure actuator 70 contributes to the compactness of the negative pressure actuator.

According to the first to fourth embodiments as described above, the negative pressure actuator is used as a drive means for the throttle shaft and the valve member, but such negative pressure actuator may be replaced by an electrical motor. Furthermore, an electromagnetic solenoid may be used as an actuator for driving the valve member.

What is claimed is:

1. An exhaust gas recirculation system for an internal combustion engine, comprising:

an intake passage leading to said engine;

an exhaust gas passage for introducing exhaust gas into said air intake passage;

an EGR control valve for opening and closing said exhaust gas passage;

an axis of said air intake passage and an axis of said EGR control valve being disposed perpendicularly to each other;

said EGR control valve being disposed at a location deviating from a diameter of said air intake passage and in contact therewith;

a throttle body forming said air intake passage therein;

a throttle valve supported by said throttle body and rotatable around a throttle shaft thereof;

at least a portion of said EGR control valve being accommodated in said throttle body;

the axial direction of said EGR control valve being disposed in parallel with said throttle shaft; and at least a portion of said EGR control valve being overlapped with a projection area of said throttle valve in a radial direction of said air intake passage which is perpendicular to said throttle shaft.

2. An exhaust gas recirculation system for an internal combustion engine, comprising:

a throttle body having an air intake passage leading to said engine;

a throttle valve pivotally supported by a throttle shaft in said air intake passage for regulating air flow into said engine;

an EGR control valve for opening and closing an exhaust gas passage which introduces exhaust gas into said air intake passage;

an axis of said EGR control valve being disposed in parallel with said throttle shaft of said throttle valve;

said EGR control valve having a communicating port for leading said exhaust gas passage to said air intake passage and opened only in a downstream direction at a downstream side of said throttle valve;

said EGR control valve including a valve member disposed on one axial side of said communicating port for opening and closing said exhaust passage, an actuator disposed on the other axial side of said communicating port for driving said valve member, and a coupling device disposed between said actuator to said valve member to transmit a driving force of said actuator to said valve member; and said actuator including a diaphragm actuator.

3. An exhaust gas recirculation system for an internal combustion engine, comprising:

a throttle body having an air intake passage leading to said engine;

a throttle valve supported by a throttle shaft in said intake passage for regulating air flow into said engine;

an exhaust gas inlet mounted on said throttle body at a position radially outside said intake passage for introducing exhaust gas into said air intake passage, said inlet extending perpendicularly to an axis of said intake passage and communicating with said intake passage;

a valve member disposed between said intake passage and said inlet for controlling introduction of the exhaust gas from said inlet into said intake passage, said valve member being axially movable in a direction in which said inlet extends and directly exposed to said air intake passage;

an actuator mounted on said throttle body at a position radially outside said intake passage; and a coupling member connecting said valve member to said actuator and extending in a direction in which said inlet extends, said coupling member being disposed to be exposed to said air intake passage.

4. An exhaust gas recirculation system for an internal combustion engine, comprising:

a throttle body having an air intake passage leading to said engine;

a throttle valve supported by a throttle shaft in said intake passage for regulating air flow into said engine; and an exhaust gas control valve unit having an actuator at one axial end, a valve member at the other axial end and an axially extending coupling member between said actuator and said valve member, said unit being mounted on said throttle body at a position radially outside said intake passage to cross said throttle body perpendicularly, said valve member and said actuator being disposed oppositely with respect to said intake passage.

5. An exhaust gas recirculation system for an internal combustion engine as in claim 4, further comprising:

an exhaust gas inlet mounted on said throttle body at a position radially outside said intake passage for introducing exhaust gas into said air intake passage, said inlet extending perpendicularly to an axis of said intake passage and communicating with said intake passage, wherein said valve member is disposed between said intake passage and said inlet for controlling introduction of the exhaust gas from said inlet into said intake passage, said valve member and said coupling member being axially movable in a direction in which said inlet extends and directly exposed to said air intake passage.

6. An exhaust gas recirculation system for an internal combustion engine as in claim 4, wherein:

said exhaust gas control valve unit is in parallel with said shaft throttle shaft.

7. An exhaust gas recirculation (EGR) system for an internal combustion engine, said system comprising:

a throttle valve disposed in an air intake passage and having a rotatable actuator shaft disposed perpendicular to the air intake passage;

an EGR valve disposed at least partially within said air intake passage downstream of said throttle valve and having a separate reciprocatable actuator shaft also disposed perpendicular to the air intake passage.

8. An exhaust gas recirculation system as in claim 7 wherein said rotatable actuator shaft is at least approximately parallel to said reciprocatable actuator shaft.

9. An exhaust gas recirculation system as in claim 7 wherein a central portion of said reciprocatable actuator shaft is exposed to cooling intake air flowing through said air intake passage.

10. An exhaust gas recirculation system as in claim 7 further comprising:

a throttle actuator disposed on one side of said system to controllably rotate the throttle valve; and an EGR valve actuator also disposed on the same side of said system to controllably reciprocate the EGR valve.

11. An exhaust gas recirculation system for an internal combustion engine, comprising:

a throttle body having an air intake passage leading to said engine;

a throttle valve pivotally supported by a throttle shaft in said air intake passage for regulating air flow into said engine;

an EGR control valve mounted integrally on said throttle body to cross said throttle body for opening and closing an exhaust gas passage which introduces exhaust gas into said air intake passage; and an axis of said EGR control valve is disposed in parallel with said throttle shaft of said throttle valve.

12. An exhaust gas recirculation system as in claim 11, wherein:

an axis of said air intake passage and the axis of said EGR control valve are disposed perpendicularly to each other; and said EGR control valve is disposed at a location deviating from a diameter of said air intake passage and in contact therewith for being cooled by the air flow in said air intake passage.

13. An exhaust gas recirculation system as in claim 11, wherein:

said valve member is disposed to move towards an upstream side of an exhaust gas flow for opening said EGR control valve.

14. An exhaust gas recirculation system as in claim 11, wherein:

said EGR control valve has a communicating port for leading said exhaust gas passage to said air intake passage and opened only in a downstream direction at a downstream side of said throttle valve.

15. An exhaust gas recirculation system as in claim 14, wherein:

said EGR control valve includes;

a valve member disposed radially outside said intake passage on one axial side of said communicating port for opening and closing said exhaust passage, an actuator disposed radially outside said intake passage on the other axial side of said communicating port for driving said valve member, and a coupling, device disposed between said actuator to said valve member to transmit a driving force of said actuator to said valve member.

16. An exhaust gas recirculation system as in claim 15, wherein:

said coupling device is exposed to the flow of intake air between said communicating port and said actuator.

17. An exhaust gas recirculation system for an internal combustion engine, comprising:

a throttle body forming an intake passage leading to said engine;

an exhaust gas passage having an inlet for introducing exhaust gas into said air intake passage;

an EGR control valve axially aligned with said inlet for opening and closing said exhaust gas passage;

an axis of said air intake passage and axes of said EGR control valve and said inlet being disposed perpendicularly to each other; and said EGR control valve and said inlet being disposed at a location deviating from a diameter of said air intake passage and in contact therewith for being cooled by the flow of intake air flowing through said intake passage.

18. An exhaust gas recirculation system as in claim 17, wherein:

said EGR control valve includes a diaphragm actuator.

19. An exhaust gas recirculation system as in claim 17, further comprising:

a throttle valve supported in said throttle body and rotatable around a throttle shaft thereof;

at least a portion of said EGR control valve being accommodated in said throttle body; and the axial direction of said EGR control valve being disposed in parallel with said throttle shaft.

20. An exhaust gas recirculation system as in claim 19 wherein:

said throttle body has a partition wall which separates said exhaust gas passage and said air intake passage thereby to lead the exhaust gas passage to open only in the downstream direction at the downstream side of said throttle valve.

21. An exhaust recirculation system as in claim 19, wherein:

said exhaust gas passage leading to said air intake passage opens at the side of one of two pieces provided at both sides of said throttle shaft, which rotates towards the upstream side when said throttle valve opens.

22. An exhaust gas recirculation system as in claim 17, wherein:

said EGR control valve has a communicating port positioned adjacent to said inlet and opened only in a downstream direction in said air intake passage.

23. An exhaust gas recirculation system as in claim 22, wherein:

said EGR control valve includes;

a valve member disposed radially outside said intake passage and on one axial side of said communicating port for opening and closing said exhaust passage, an actuator disposed radially outside said intake passage and on the other axial side of said communicating port for driving said valve member, and a coupling device disposed between said actuator to said valve member to transmit a driving force of said actuator to said valve member.

24. An exhaust gas recirculation system as in claim 23, wherein:

said coupling device and said valve member are exposed to the flow of intake air between said communicating port and said actuator.

25. An exhaust gas recirculation system as in claim 23, wherein:

said valve member is disposed to move towards an upstream side of an exhaust gas flow for opening said EGR control valve.

26. An exhaust gas recirculation system as in claim 25, wherein:

said actuator includes a diaphragm actuator and is disposed radially outside said throttle body.

* * * * *